United States Patent [19]

Kotterer

[11] Patent Number: 4,887,532

[45] Date of Patent: Dec. 19, 1989

[54] A STOP MOTION DEVICE FOR A WEB FEED PRINTING PRESS

[75] Inventor: Werner J. Kotterer, Diedorf, Fed. Rep. of Germany

[73] Assignee: Grafotec Kotterer GmbH, Diedorf, Fed. Rep. of Germany

[21] Appl. No.: 270,064

[22] Filed: Nov. 14, 1988

[30] Foreign Application Priority Data

Dec. 2, 1987 [DE] Fed. Rep. of Germany ..... 3740812
Jul. 2, 1988 [DE] Fed. Rep. of Germany ..... 3822497

[51] Int. Cl.[4] ..... B41F 13/56

[52] U.S. Cl. ..... 101/225; 226/11; 226/45; 242/57

[58] Field of Search ..... 101/225–228, 101/216, 351, 352, 218, 219, 209, 139–140, 143, 144, 145, 182, 184, 185, 247; 226/11, 45; 83/371; 242/57, 75.43; 400/708

[56] References Cited

U.S. PATENT DOCUMENTS

| | | | |
|---|---|---|---|
| 2,965,023 | 12/1960 | Boule et al. | 101/352 |
| 3,317,734 | 4/1967 | Martin, Jr. | 226/11. |
| 3,323,699 | 6/1967 | Bricker, Jr. | 226/45 |
| 3,404,627 | 10/1968 | Halley | 226/11 |
| 3,638,568 | 2/1972 | Granger | 101/219 |
| 3,722,773 | 3/1973 | Plate et al. | 226/45 |
| 3,928,844 | 12/1975 | Meihofer | 83/371 |
| 3,958,735 | 5/1976 | Wanat | 226/45 |
| 4,154,004 | 5/1979 | Trotscher | 226/45 |
| 4,523,522 | 6/1985 | Fischer | 101/219 |
| 4,549,485 | 10/1985 | Nawrath | 101/219 |
| 4,549,826 | 10/1985 | Stoeberl | 400/708 |
| 4,558,216 | 12/1985 | Rodi et al. | 226/45 |
| 4,667,946 | 4/1987 | Taguchi et al. | 101/226 |
| 4,709,872 | 12/1987 | Hammer et al. | 242/75.43 |
| 4,714,946 | 12/1987 | Bajgert et al. | 355/145 H |
| 4,754,702 | 7/1988 | Muller | 101/225 X |

*Primary Examiner*—E. H. Eickholt
*Attorney, Agent, or Firm*—Jones & Tullar & Cooper

[57] ABSTRACT

In the context of a stop motion device for a web feed printing press comprising a web interrupting device placed on the delivery side of a printing unit of the printing press and having a slot for the web from the unit to run, in order to achieve greater ease of operation and functional reliability there is at least one web tear detector switch which is structurally united with the web interrupting device and is adapted to respond to contact with the web and is placed clear of a plane occupied by the web during trouble-free operation of the press and in a position at which there will be an angular deflection of the web, free of tension, caused by an entraining cylinder, when the web tears.

14 Claims, 2 Drawing Sheets

A STOP MOTION DEVICE FOR A WEB FEED PRINTING PRESS

BACKGROUND OF THE INVENTION

The invention relates to a stop motion device for web feed printing presses of the type having at least one web interrupting (i. e. gripping and/or severing) device arranged between the last printing unit and a dryer and able to be triggered by a sensor responsive to a tear in the web.

A stop motion device of this type has been described in the German pre-examination patent specification No. 3,431,686 in which a web clamping device mounted on the dryer is operated by a paper detector switch which is arranged downstream from a dryer or from a cooler following the dryer. Although this position for accommodating the paper detector switch is somewhat where tears are prone to occur in the web, it is not necessarily the case that every tear in the web leads to the web winding itself up on parts of the machinery and thus to the danger of damage thereto. Such a danger is in fact only present if paper web, which has ink on it, runs slack owing to a tear so that the ink causes it to stick to an inking cylinder in the press, that is to say, in the case of an offset litho press, a blanker cylinder, so that the paper winds itself up onto the blanket cylinder. In such a case the web has to be quickly gripped and/or cut in order to prevent damage to the plant. In other cases this is not necessary and only necessitates renewed draw in of the web from the position of severance and resetting of the web gripping and/or cutting device. In the known arrangement with a paper detector switch arranged after the dryer the web gripping and/or cutting device is put into operation every time that is to say without drawing any distinction between the danger of the web winding itself up on a part of the press and or the absence of such a danger. Accordingly the known device is not easy to operate. A further fact is that the sensing of the web takes place downstream from the dryer, a mechanically functioning sliding shoe generally being used which rides on the web and has a very long response time so that if there is a need to take prompt action the web interrupting device is frequently not triggered early enough. The known arrangement is consequently not sufficiently reliable in operation.

SUMMARY OF THE INVENTION

Accordingly one object of the present invention is to avoid the shortcomings of the prior art and to devise a stop motion device of the initially described type with simple and low-price means such that ease of operation is significantly increased.

A further aim of the invention is to provide such an apparatus with increased safety and reliability.

In order to attain these and other objects the web sensor comprises at least one web detector switch which is structurally united with the web interrupting means and is arranged with the latter at a distance from the feed plane occupied by the web during trouble-free operation at a position in which, when the web tears, there is an angular deflection of the web caused by a cylinder entraining the slack web.

In this case advantageous use is made of the angular deflection of the web, which necessarily takes place when the web wraps itself up on some part of the press, in order to trigger the web interrupting means, that is to say the means cutting and/or gripping the web. The measures provided by the invention thus ensure that it is not each and every tear in the web which will cause the web interrupting means to be triggered, but only in those cases in which the web tear is such as to cause the web to be angularly deflected, that is to say when there is a tangible danger of the plant being damaged. Thus unnecessary interruption of web feed is precluded, thus greatly enhancing the ease of operation of the press. A further advantage is the relatively short response time. In this connection it is in fact to be assumed that when the paper web is entrained, that is to say when same is angularly deflected, such deflection takes place even while the paper web is in the process of tearing or immediately thereafter. The paper web stop motion device in accordance with the present invention is thus able to react even before the time in which a trailing shoe or the like placed after the dryer would not yet be able to react. A further advantage of the invention is to be seen in the fact that a web detector switch is able to be used which is not contacted by the web during trouble-free operation. This freedom from contact means less soiling of the detector switches.

These features of the invention on the one hand lead to a compact structural unit which has the advantage of being able to be mounted in a preassembled condition. Owing to the integration of the detector switch with the web interrupting means one may still be sure that the printing press is readily accessible, thus enhancing the ease of operation. A further beneficial effect due to the invention with the integration of the web detector switch with the web interrupting means is that there is then automatically a protective housing for the web detector switches. The switches may thus be advantageously designed in the form of sensitive components without moving parts, as for instance in the form of a capacitive switch, which do not offer any resistance to the web.

In accordance with a further advantage development of the invention it is possible to have web detector switches placed generally opposite to each other in relation to the web. This will mean that a preferred direction of deflection of the web does not have to be chosen and thus ensures a particularly high degree of operational reliability.

In accordance with a further advantageous form of the invention the web detector switch or switches may have a mechanical detector member which is deflected by the web and is in the form of a rail extending across the entire operational width and which in its resting position bears on an abutment and in a position moved clear of the abutment operates a control. These features ensure in an advantageous manner that a mechanical switch may be used which however during normal, trouble-free operation has the web moving past it without making contact. Such a switch has the further useful effect of being completely resistant to soiling and jerks. Thus such a web detector switch has the added advantage that it may be used in the proximity of a printing unit of the press without the ink mist necessarily caused by the unit impairing operational reliability of the detector switch. A further advantage is to be seen in the fact that owing to the length of the rail extending across the full breadth there is no need to adjust it.

Further advantageous features and details of the invention will now be seen from the account of some working embodiments thereof as shown in the accompanying drawings.

DETAILED DESCRIPTION OF THE PREFERRED EMBODIMENTS OF THE INVENTION.

Figure 1:
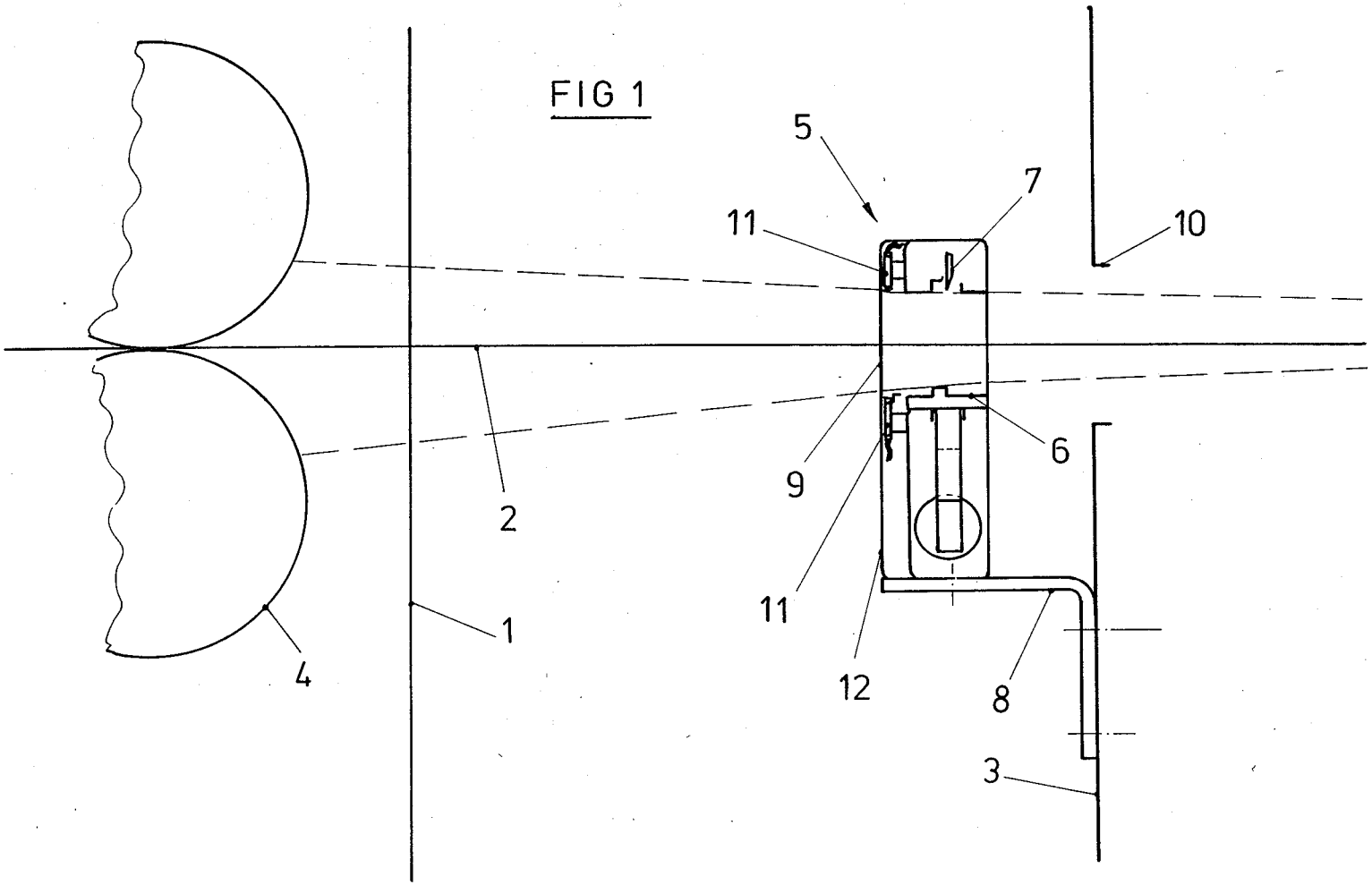
FIG. 1 is a side view of one example of the invention with capacitive web detector switches.
Figure 2:
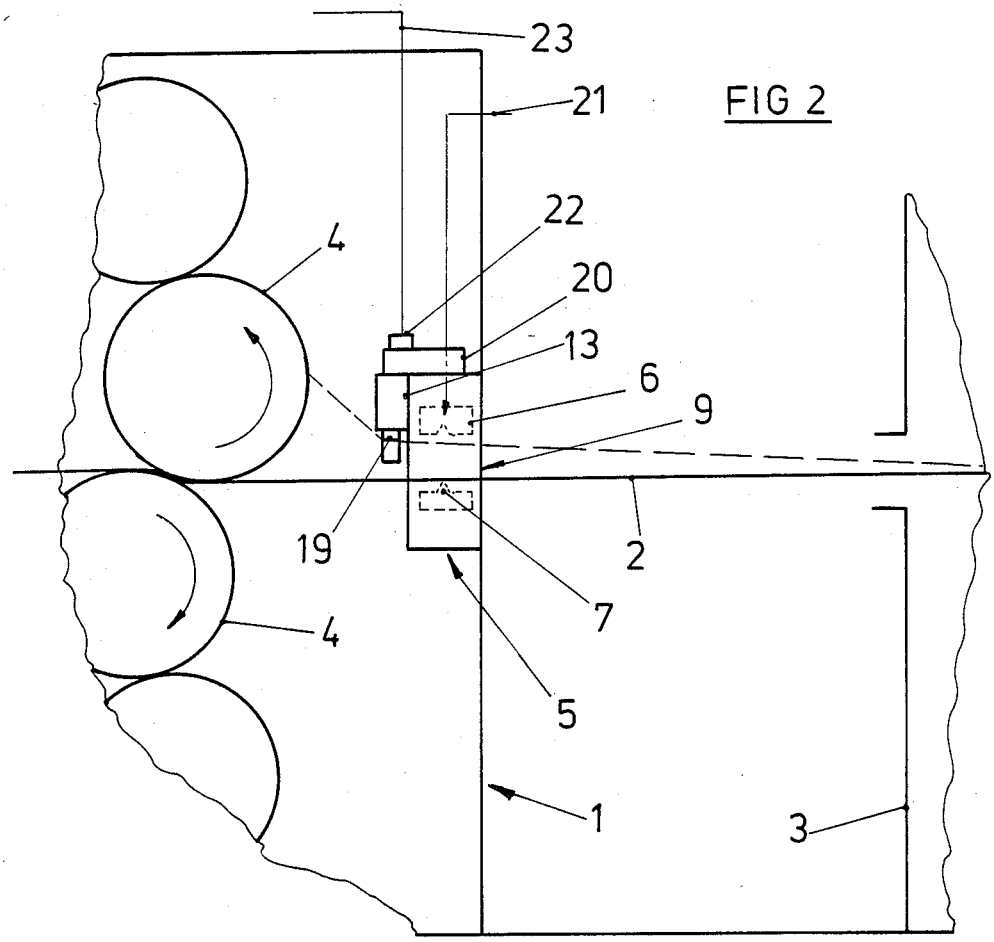
FIG. 2 shows a side view of one embodiment of the invention, this time with a mechanical detector switch.

In FIGS. 1 and 2 there is shown the last printing unit 1 of a web feed offset litho press in which a paper web 2 is in the process of being printed. The printed web 2 runs into a dryer 3 arranged at the delivery end of the press in which the web 2 is subjected to the action of drying air. Owing to the substantial temperature gradient at the dryer stresses are produced in the web which are prone to cause tears therein.

The printing ink transferred to the web 2 is very tacky, more especially in the case of offset litho printing. During a trouble-free run the web 2 is pulled clear of the cylinders cooperating with it by the tension in the web which overcomes the adhesion due to the tackiness. In the case of an offset litho machine, as here, these cylinders will be rubber blanket cylinders 4. When the web tears adjacent to the dryer the web will consequently become slack and will remain adhered to one of the cylinders 4 between which it runs, and the web is then likely to wind itself up on one of the cylinders. This is indicated by a deflection of the web 2 as marked by a broken line.

In order then to avoid damage to the press there is provided a web interrupting means 5, capable of gripping and/or cutting the web, placed between the last printing unit 1 of the press and the dryer 3. This web interrupting means is provided with gripping jaws 6 and/or knives 7 able to be moved towards each other. The interrupting means is arranged to be operated by the deflection of the web 2 as indicated by the broken line. It is with the aid of this means 5 that the web 2 is grippd or cut so that it is not possible for the cylinder 4 entraining it to pull the web back out of the dryer 3.

In the design shown in FIG. 2 the web interrupting means 5 is arranged on the intake side of the dryer so that its slot 9, through which the web is threaded, is on the intake side of the intake slot 10 of the dryer 3. During trouble-free operation in which the web moves along the full line, there is no contact between the web 2 and the sides of the slot 9. The deflection of the web 2 as marked in broken lines may in the design of FIG. 2, in which there is no substantial offset between the cylinders 4 cooperating with the web, take place in either direction. In order in either case to reliably detect such deflection there are in the present case two oppositely placed tear detector switches 11 placed on the two sides of the web run moving between the printing unit 1 and the dryer 3. These detector switches are in the present case integrated in the housing of the web interrupting means 5. In the illustrated working embodiment of the invention the tear detector switches 11 are placed in the vicinity of the upper and lower edges of the inlet aperture of the slot 9.

The two oppositely placed tear detector switches 11 are designed in the form of capacitive switches whose electrostatic field will be affected by any deflection of the web 2 involving a change in the plane in which it is fed to the dryer. When there is such a deflection in a downward direction the lower tear detector switch will be operated and the upper one will be actuated by an upward drift of the web. The oppositely placed tear detector switches 11 are suitably connected with each by means of an OR gate. The capacitive switches are directionally insensitive so that it possible to use the same switch component for the upper and lower switches. The accommodation of the tear detector switches 11 in respective chambers in the housing 12 in the web interrupting means 5 furthermore means that the switches 11 are protected against impacts and dirt so that no trouble conditions are to be feared from any atomized ink, which in any case tends to becomes less intense towards the dryer 3.

In the example of the invention to be seen in FIG. 2 the web interrupting means 5 is located at the delivery of the printing unit 1. The main points of the design of the web interrupting means are the same as those of that shown in FIG. 1 so that reference may be had to the account thereof. In order to avoid any type of sensitivity to soiling of a tear detector switch 13, which in the present case is integrated with the web interrupting means to form a single unit, the detector switch 13 is in the form of a thrust switch able to be mechanically triggered by the web when same is deflected out of its feed plane. In the design shown in FIG. 2 the blanket cylinders cooperating with the web 2 are offset from each other by a comparatively large distance in order to obtain the largest possible wrap of the web about the same and the web 2 then leaves the upper rubber blanket cylinder very much later than the lower blanket cylinder 4. In the case of such a placement of the cylinders it has been seen from experience that when the web tears it will be deflected towards the side on which there is the cylinder 4 which the web last left. In the case of the design shown in FIG. 2 it is thus sufficient to have a single web tear detector switch 13 arranged over the web 2. This web tear detector switch mounted on the web interrupting means at the delivery of the press is in the direct vicinity of the cylinder 4 deflecting the web 2 when a tear occurs and it is thus where the web deflection is greatest so that despite the mechanical mode of operation of the web torn detector switch 13 there is a reliable function of the switch.

Figure 3:
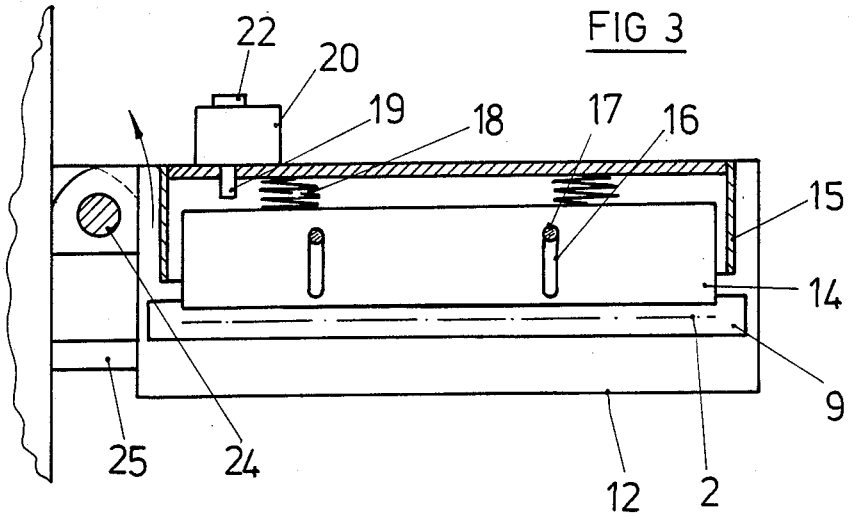
FIG. 3 is a longitudinal section taken through the mechanical web detector switch of FIG. 2.

The mechanical web tear detector switch 13 provided in the present case has, as may be best seen from FIG. 3, a rail 14 which extends over the full working width of the printing unit 1 and which is placed in a housing 15 from which it may be caused to move as far as an abutment. For this purpose the rail 14 is provided with two slots 16 extending in a direction perpendicular to the plane of the paper web 2 and there are respective abutment pins 17, fixed to the housing, extending through the slots. The housing 15, which in the present case is mounted on the housing 12 of the web interrupting means 5, has a generally U-like cross section so that between limbs of the housing connected with each other by the abutment pins 17 there is a reliable guiding action on the rail 14. The end sides of the housing may be shut off by end plates.

The outward motion of the rail, which in the present case is downwards, may be caused by the weight of the rail. In the illustrated working example of the invention the outward motion is aided by two drive out springs 18 acting on the back side of the rail. However here it is a question of very light springs so that the rail 14 may be lifted against the force of gravity and the spring force by the paper web 2 which is moved out of place following a tear in the web. The rail 14 consists of plastic and thus has a self-lubricating action and is resistant to corrosion and thus needs little maintenance. Since the rail 14 may have a relatively large degree of backlash, large tolerances may be allowed for the manufacture of the housing 15.

A control valve 20 is mounted on the housing 15 so that its operating rod 19 extends down into the housing. The operating or control valve 20 is arranged on the power line 21 leading to the drive means for the web interrupting means. The drive means may be in the form of compressed air actuators which are supplied with actuating air arriving at the operating valve 20 and allowed to flow through it when it is opened. The operating rod 19 is so arranged that it may be pressed through the back side of the rail 14.

During trouble-free normal operation the web 2 runs past the lower side of the rail 14, moved out so to abut, from the associated housing 15 without making contact with such rail and also runs past the web interrupting means (in the form of jaws 6 and knives 7 as gripping and cutting members) without contact. When the web tears so that it is then deflected the rail 14 is lifted clear of the deflected web, the operating rod 19 running against the back side of the rail and being depressed. As a result the valve 20 is opened so that the web interrupting means in the form of the jaws 6 and knives 7 are moved into engagement with each other.

There is also a switch 22, able to be operated by means of the operating rod 19, mounted on the valve 20 in the illustrated example. This switch is arranged in a feed line 23 for stopping the press.

The entire unit (formed by the web interrupting means 5 with the web tear switch 13 mounted thereon and the control parts thereon in the form of the valve 20 and of the switch 22) which in the present case is arranged at the delivery of the printing unit 1 in order to ensure reliable operation of the web tear detector switch, is mounted for pivoting at one end about a generally horizontal shaft 24 on one side wall of the printing unit so that it may be moved upwards in order to ensure ready accessibility to the cylinders of the printing unit, as may best be seen from FIG. 3. In order to support this unit in the normal operating setting it is possible to have a stop 25 placed under the shaft 24.

I claim:

1. A stop motion device for a web feed printing press, comprising:

a printing unit defining a delivery side from which a web is delivered out of the printing unit;

web interrupting means located on the delivery side of said printing unit, said web interrupting means having a slot for the passage of the web, the web defining a trouble-free operation plane between the printing unit and the web interrupting means; and at least one web tear detector switch connected to said web interrupting means and adapted to respond to contact with the web when the web is free of tension and angularly displaced relative to the trouble-free operation plane, caused by a tear in the web.

2. The stop motion device as claimed in claim comprising at least 15, wherein two web tear detector switches are provided placed on two sides of the web so as to be generally opposite each other.

3. The stop motion device as claimed in claim 1, wherein the at least one web tear detector switch is arranged adjacent to an edge of an inlet into said slot at a position vertically spaced from the web but vertically aligned therewith.

4. The stop motion device as claimed in claim 1, wherein the web interrupting means and the at least one tear detector switch from a unit arranged so as to pivot upwards about a shaft at one end, of said unit.

5. The stop motion, device as claimed in claim 1 wherein the at least one tear detector switch comprises at least one capacitive switch.

6. The stop motion device as claimed in claim 1 wherein said interrupting means is placed adjacent a dryer on the delivery end of said press.

7. The stop motion device as claimed in claim 1 wherein said web interrupting means comprises a web gripping and/or a web cutting means.

8. A stop motion device for a web feed printing press, comprising:

a printing unit defining a delivery side from which a web is delivered out of the printing unit;

web interrupting means located on the delivery side of said printing unit, a slot for the passage of the web, the web defining a trouble-free operation plane between the printing unit and the web interrupting means; and at least one web tear detector switch connected to said web interrupting means and adapted to respond to contact with the web when the web is free of tension and angularly displaced relative to the trouble-free operation plane, caused by a tear in the web.

9. The stop motion device as claimed in claim 8 wherein said switch further includes a U-like housing defining well within which said rail exends with play, and whereas said rail may be moved out as far as to abut against said U-like housing.

10. The stop motion device as claimed in claim 8, wherein said abutment means comprises a plurality of rods, and wherein the rail includes at least one slot parallel to its direction of movement in which it is moved outwards into which a rod extends.

11. The stop motion device as claimed in claim 10, wherein the rail comprises a plastic rail.

12. A stop motion device for a web feed printing press, comprising:

a printing unit defining a delivery side from which a web is delivered out of the printing unit;

web interrupting means located on the delivery side of said printing unit, said web interrupting means having a slot for the passage of the web, the web defining a trouble-free operation plane between the printing unit and the web interruptive means, said web interrupting means including a spool value; and at least one web tear detector switch connected to said web interrupting means and adapted to respond to contact with the web when the web is free of tension and angularly displaced relative to the trouble-free operation plane, caused by a tear in the web, said at least one detector switch comprising a detector member in the form of a plastic rail, and drive spring means, said detector member being operated by said spool valve.

13. The stop motion device as claimed in claim 12, wherein said web interrupting means comprises a power supply line leading thereto, and wherein the operations part comprises an operating member with an operative rod extending in to the housing so that it may be operated by the rail so as to directly operate the operating member by opening the power supply line.

14. The stop motion device as claimed in claim 13, further comprising a further switch connected with the printing press by a signal line for shutdown of said printing press, said further switch being able to be operated by said at least one web tear detector switch.

* * * * *